United States Patent [19]

Stout et al.

[11] Patent Number: 4,611,660

[45] Date of Patent: Sep. 16, 1986

[54] WIRELINE CONVEYED FIRING MECHANISM FOR WELL PERFORATING GUN

[75] Inventors: Gregg W. Stout, Montgomery; Elmer R. Peterson, Houston, both of Tex.

[73] Assignee: Baker Oil Tools, Inc., Orange, Calif.

[21] Appl. No.: 742,097

[22] Filed: Jun. 6, 1985

[51] Int. Cl.[4] ..... E21B 43/116

[52] U.S. Cl. ..... 166/297; 166/55; 175/4.56

[58] Field of Search ..... 166/297, 298, 299, 55, 166/55.1; 102/305, 306, 314, 318, 322; 175/4.54, 4.56

[56] References Cited

U.S. PATENT DOCUMENTS

| | | | |
|---|---|---|---|
| 4,484,639 | 11/1984 | Ayres | 175/4.56 |
| 4,491,185 | 1/1985 | McClure | 175/4.56 |
| 4,515,217 | 5/1985 | Stout | 166/297 |
| 4,526,233 | 7/1985 | Stout | 166/297 X |
| 4,544,034 | 10/1985 | George | 166/297 |

*Primary Examiner*—James A. Leppink
*Assistant Examiner*—Thuy M. Bui
*Attorney, Agent, or Firm*—Norvell & Associates

[57] ABSTRACT

A firing mechanism for a downhole perforating gun comprises two cooperating housing sections having closed end walls in abutment. The lower housing section contains a booster charge and the primer cord for firing the gun. The upper housing section contains a detonatable primer, a hammer, and a downwardly directed explosive charge positioned between the primer and the bottom end wall of the upper housing. The upper housing is secured to the lower housing by a collet latch which, if firing of the gun does not occur, can be released by the exertion of a substantial upward force on a fishing neck provided in the assemblage of the upper housing. The defective elements can then be repaired or replaced, the upper housing reinserted in the well by wireline, and latched into an operative position with respect to the lower housing to permit another attempt to fire the perforating gun.

14 Claims, 6 Drawing Figures

WIRELINE CONVEYED FIRING MECHANISM FOR WELL PERFORATING GUN

BACKGROUND OF THE INVENTION

1. Field of the Invention

The invention relates to a firing mechanism for a subterranean well perforating gun which may be installed in the wall either with the perforating gun, or subsequent to the placement of the perforating gun in the well, and, in the event that the firing mechanism does not function, can be retrieved from the well and replaced by another firing mechanism in order to effect the firing of the gun.

2. History of the Prior Art

In the completion of modern subterranean wells of substantial depth, it has become a common practice to employ a perforating gun that is run into the well on the bottom of a tubing string. A packer is incorporated in the tubing string and is set in the well casing so as to position the perforating gun adjacent the production formation. This practice has the advantage of permitting a much larger perforating gun to be employed than is possible if the gun were run into the well through a tubing string on a wireline. More importantly, it permits the perforating of the well in the so-called "underbalanced" condition wherein the fluid pressure existing in the tubing string adjacent the formation is substantially less than the anticipated fluid pressure of the production formation after the perforating operation is completed. This permits a relatively high velocity flow of production fluid from the newly formed perforations into the tubing string, thus flushing the perforations of the debris that is commonly associated with the perforating operation.

One negative factor encountered in the mounting of a perforating gun on the bottom of the tubing string is the high cost involved in replacing the gun in the event the gun fails to fire. Obviously, the entire tubing string must be withdrawn from the well, the firing mechanism for the perforating gun repaired or replaced, and then the perforating gun again run into the well on a newly formed tubing string. In a deep well this involved a delay of many hours in completing the well.

There is, therefore, a definitive need for a retrievable and replaceable firing mechanism for a tubing carried perforating gun which may be retrieved from the well and replaced by wireline in the event that the firing mechanism fails to operate.

SUMMARY OF THE INVENTION

The invention provides a replaceable firing mechanism for a tubing carried perforating gun which is installed in a subterranean well at a desired location by the setting of a packer incorporated in the tubing string. The firing mechanism for the perforating gun comprises two axially aligned hollow housings. The lower housing has a thin walled solid upper end and contains a conventional booster charge and a primer cord which extends from the booster charge to each of the shaped charges conventionally mounted in vertically and angularly spaced relationship in the perforating gun. The second or upper hollow housing element of the firing mechanism has a thin walled solid bottom portion which is normally disposed in abutting or closely adjacent relationship to the solid top end portion of the first mentioned or lower hollow housing. The upper housing element contains an impact detonatable primer and a downwardly directed shaped charge which is disposed between the primer and the solid bottom end wall of the upper hollow housing. The upper open end of the upper hollow housing is partially closed by an annular hammer support sleeve. A hammer is slidably mounted within the support sleeve and is relatively movable with respect to the primer, which is fixedly mounted within the housing, from a remote or upwardly spaced position to a contiguous position. Such movement of the hammer is produced by a wireline engagable member, similar to a fishing neck, which is secured to the hammer. An outer sleeve is also secured to the wireline engagable member and projects downwardly in surrounding relationship to both the upper housing and the upper portion of the lower housing. A shear pin normally holds the sleeve in a fixed axial position with respect to the upper housing, thus maintaining the hammer in its remote position with respect to the primer.

The lower housing is provided with an external downwardly facing latching surface and a latching collet is disposed between the lower end of the outer sleeve and the outer periphery of the lower housing. The latching collet is provided with a plurality of spring arms having upwardly facing latching surfaces which are engagable with the downwardly facing latching surface provided on the lower housing. The latching collet is retained in its latching position, securing the upper and lower housings in axially abutting relationship by a collet support ring which is shearably secured to the outer sleeve.

In a normal operation of the firing mechanism, the application of a downwardly directed impact force to the wireline engagable member will effect a shearing of the shear screw holding the outer sleeve, and hence the hammer, in an elevated position relative to the primer. The hammer will move downwardly to impact the primer and detonate same. The detonation of the primer will effect the detonation of the downwardly directed shaped charge and this detonation will effect the fragmentation of both the closed bottom end of the upper housing and the closed top end of the lower housing, thus transferring the detonation to the booster charge and in turn to the primer cord extending to the perforating gun. If, for any reason, the primer or the downwardly directed spaced charge malfunction, the entire upper housing of the firing mechanism, including the primer and downwardly directed spaced charge element, may be removed from the remainder of the gun by attaching a wireline to a fishing neck provided on the top end of the wireline engagable member and applying an upwardly directed force thereto. Such force effects the shearing of the shear screws holding the collet support and permits the latching collet to move out of engagement with the downwardly facing latching surface on the lower housing, thus permitting the entire upper housing assembly to be removed from the well by wireline. Such removal is obviously rapidly accomplished and the defective elements of the firing mechanism contained in the upper housing may be replaced at the well surface. The repaired or a new upper housing is then lowered into the well by wireline and the upper housing is secured in axially abutting relationship to the top end of the lower housing by the latching collet, so that the entire firing mechanism is restored to an operative condition.

Further advantages of the invention will be readily apparent to those skilled in the art from the following detailed description, taken in conjunction with the annexed sheets of drawings on which is shown a preferred embodiment of the invention.

DESCRIPTION OF THE PREFERRED EMBODIMENT

Figure 1A:
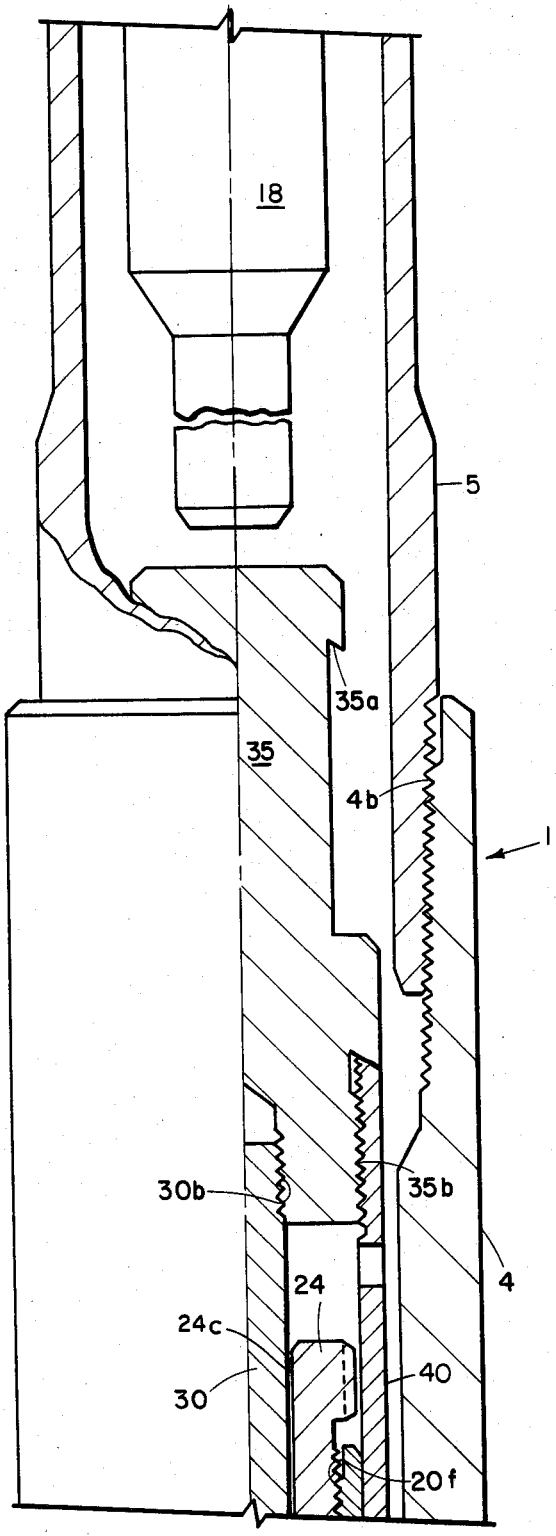
FIGS. 1A, 1B and 1C collectively represent a vertical quarter sectional view of a firing mechanism for a well perforating gun embodying this invention, with the elements of the gun shown in their run-in position, ready for firing.
Figure 1B:
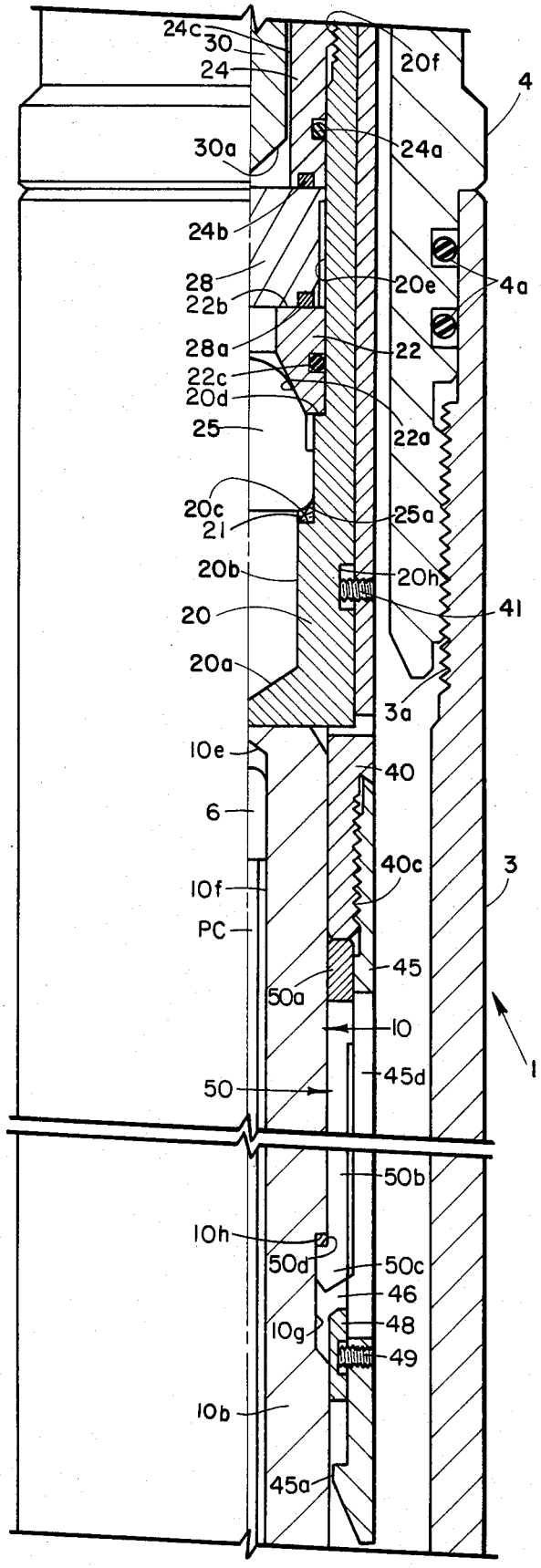
Figure 1C:
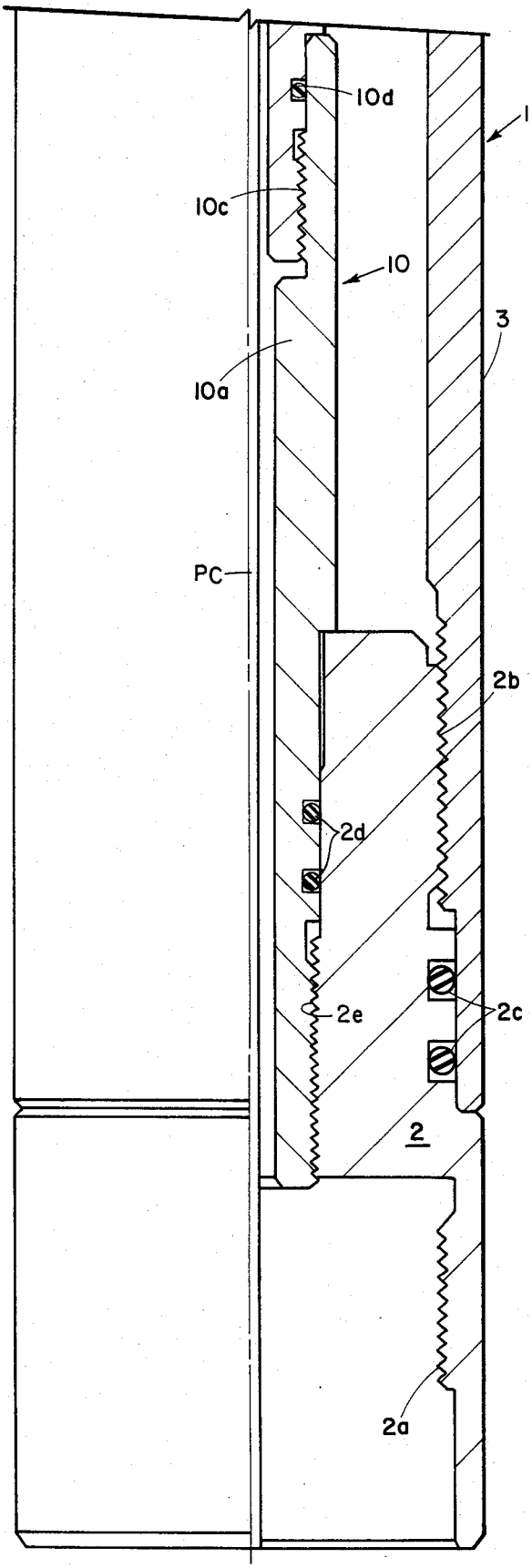
Figure 2C:
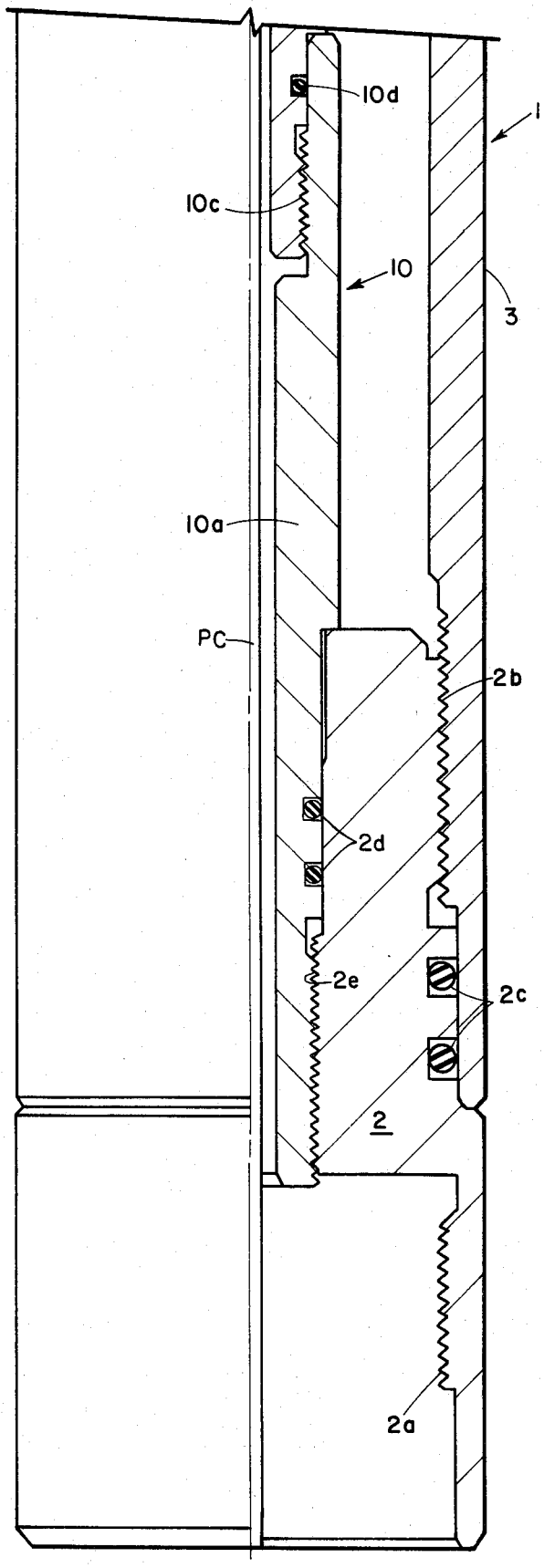

Referring to FIGS. 1A, 1B and 1C, a firing mechanism 1 embodying this invention may be secured to the top of any conventional tubing carried perforating gun (not shown) by a bottom connecting sub 2 having internal threads 2*a* for connection to the external threads conventionally provided on the top of the perforating gun. As is well known to those skilled in the art, such gun incorporates a plurality of vertically and angularly spaced shaped charges and the charges are detonated by a primer cord PC which extends downwardly into the gun into intimate contact with each of the detonating ends of each of the shaped charges (not shown). See for example Application Ser. No. 432,481, filed Oct. 4, 1982 (BSC-83) and assigned to the assignee of this application now patent No. 4,479,556.

The connecting sub 2 is provided with external threads 2*b* at its upper end for effecting a threaded connection to a length of tubing 3. O-rings 2*c* seal this threaded connection. The top end of tubing length 3 is provided with internal threads 3*a* which are connected to the bottom end of a top connecting sub 4. O-rings 4*a* seal this connection. The top sub 4 is provided with internal threads 4*b* for connection in conventional fashion to the bottom end of a tubing string 5.

The bottom sub 2 is further provided with internal threads 2*e* which threadably engage the bottom end of a hollow lower housing 10 which is formed by the threaded assemblage of two tubular members 10*a* and 10*b*. O-rings 2*d* seal the threaded connection of the lower housing 10 to the bottom sub 2 and threads 10*c* and O-ring 10*d* effect the sealed connection of the two tubular members forming the lower housing 10. Those skilled in the art will recognize that the lower housing 10 may be formed as an integral member, but the two piece construction is preferred so as to permit a variety of lengths of this housing to be selected, depending upon the amount of trash which is anticipated may collect around the housing prior to the firing of the perforating gun.

The upper end of housing element 10*b* is provided with a solid, relative thin end wall 10*e*. Within the bore 10*f* of the lower housing 10, a conventional booster charge 6 is mounted which is connected to the upper end of a primer cord PC which extends downwardly into the perforating gun (not shown). Lastly, the upper housing element 10*b* is provided with an annular recess 10*g* on its periphery defining a downwardly facing latching surface 10*h*, for a purpose to be hereinafter described.

From the description thus far, it will be apparent that the booster charge 6 and the primer cord PC are housed within the sealed interior of the lower housing 10 and thus are protected from contact with any corrosive or otherwise deleterious fluids or gasses existing in the well in the vicinity of the perforating gun. Thus, the housing 10, together with the booster charge 6 and primer cord PC, may be run into the well on the tubing string at the same time that the perforating gun (not shown) is run-in, and may remain in the well for an extended period of time without any adverse effects on the booster charge and primer cord. The tubing carried perforating gun normally employed has a completely sealed bore within which the shaped charges are mounted and these charges are likewise not effected by the well environment. See for example the aforementioned co-pending application.

The second half of the firing mechanism comprises an upper housing 20 which has a relatively thin bottom end wall 20*a* which is normally disposed in abutting relationship to the solid top wall 10*e* of the lower housing 10. Upper housing 20 defines an upwardly extending bore 20*b* which has a first counter bore defining an upwardly facing surface 20*c* upon which is mounted a nylon support ring 21 for conventional shaped charge 25 which is positioned on the support ring 21 so as to direct its explosive force downwardly. The explosive force of the downwardly directed shaped charge 25 is sufficiently great so as to blast through and fragmentize both the bottom end wall 20*a* on the upper housing 20 and the top end wall 10*e* of the lower housing 10.

A second counter bore is formed in the bore 20*b* of upper housing 20 to define an upwardly facing shoulder 20*d*. This shoulder mounts a spacer ring 22 having an inclined lower surface 22*a* engaging the conventional rounded upper surface of the downwardly directed shaped charge 25. The upper surface 22*b* of spacer ring 22 lies in a radial plane and effects an abutting engagement with the bottom end of a detonatable primer 28. An O-ring seal 28*a* seals this connection, while an O-ring seal 22*c* effects the sealing of the periphery of the spacer ring 22 with the counter bore 20*e* of the upper housing 20.

The primer 28 is held in a fixed position in the upper housing 20 by a hammer support sleeve 24 which is threadably secured to internal threads 20*f* provided at the top end of the upper housing 20. An O-ring 24*a* seals this connection while an O-ring 24*b* sealingly engages the top surface of the primer 28.

A hammer 30 having a pointed lower end 30*a* is mounted for sliding movements within the bore 24*c* of the hammer support sleeve 24. The upper end of hammer 30 is provided with external threads 30*b* for securement to internal threads provided on a wireline attachable member 35 having a fishing neck 35*a* formed on its upper extremity. Thus the position of the pointed end 30*a* of the hammer 30 relative to the primer 28 is determined by the relative position of the wireline engagable element 35 with respect to the upper housing 20.

This position is determined by an outer sleeve 40 which is secured at its upper end to external threads 35*b* provided on the lower end of the wireline engagable element 35. A shear screw 41 traverses the wall of outer sleeve 40 and engages an annular slot 20*h* formed in the lower portions of the upper housing 20. This shear screw thus determines the relative position of the wireline engagable element 35, hence the hammer 30 with respect to the primer 28.

Figure 2A:
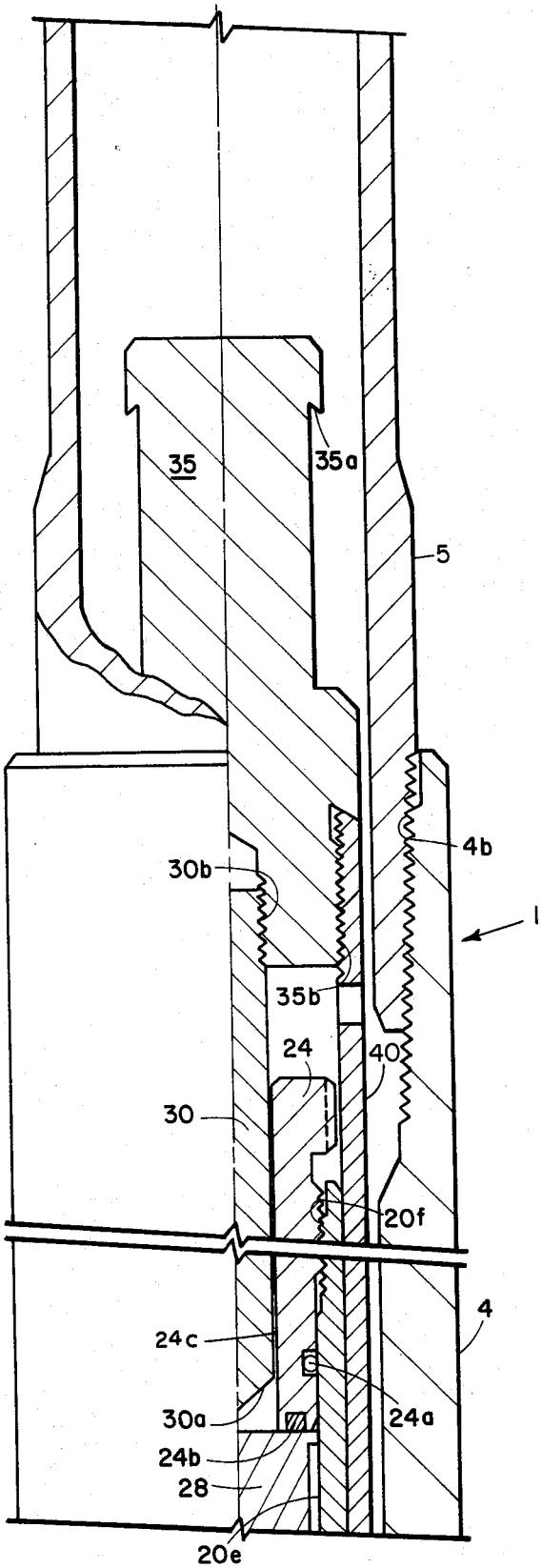
FIGS. 2A, 2B and 2C are views similar to FIGS. 1A, 1B, and 1C, respectively, but showing the release of the collet latch from the lower housing preliminary to removing the upper housing from the well.
Figure 2B:
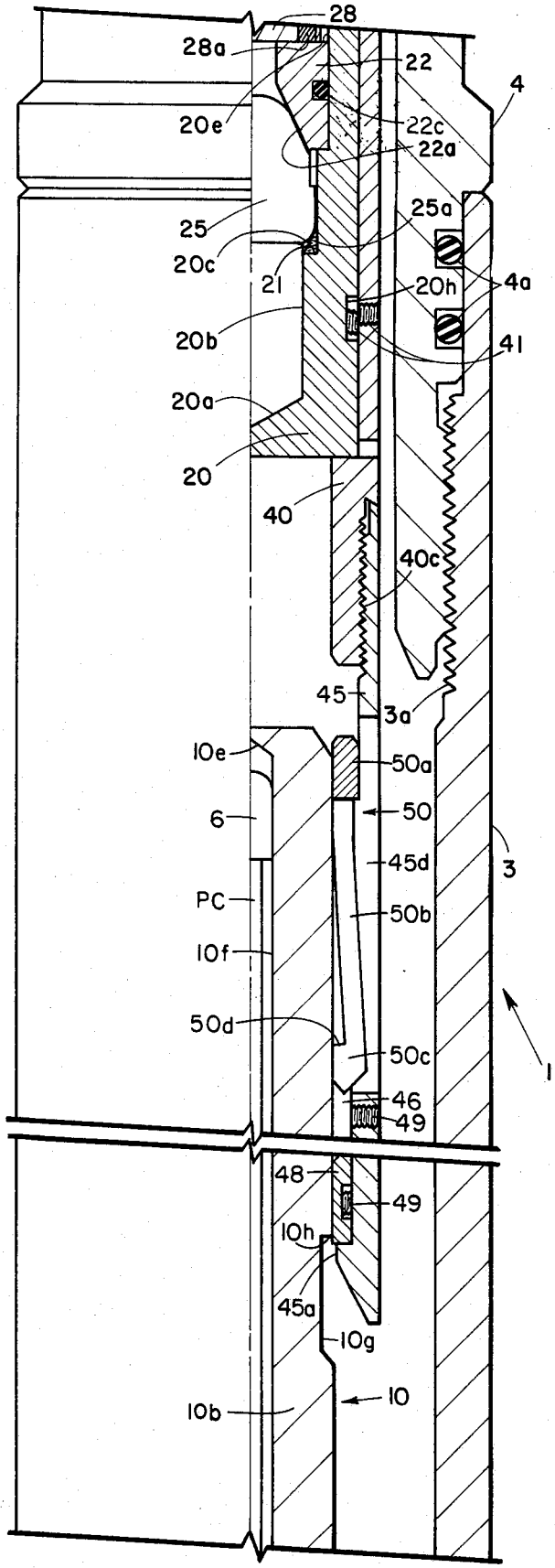

The lower end of outer sleeve 40 surrounds the upper end of the lower housing 10 and is provided with external threads 40*c*. A collet mounting sleeve 45 is secured to threads 40*c* and extends downwardly in radially spaced relationship to the outer surface of the lower housing 10, terminating in a radially inward projecting portion 45*a* which abuts the external surface of lower housing 10. The annular space 46 defined between the collet mounting sleeve 45 and the exterior surface of lower housing 10 is employed for mounting a latching collet 50 having a ring portion 50*a* and a plurality of peripherally spaced downwardly extending resilient arm portions 50*b*. The arm portions 50*b* terminate at their lower ends in a radially enlarged portion 50*c* defining an upwardly facing latching surface 50*d*. Whenever a minor upward force is applied to the wireline engagable element 35 or the outer sleeve 40, a collet locking ring 48 will move into abutting engagement with the enlarged end portions 50*c* of the collet arms 50*b* and prevent the release of such arms from the downwardly facing latching surface 10*h* provided on the lower housing 10. However, when a sufficiently large upward force is applied to the wirline engagable element 35, the shear screws 49 will be severed and the collet locking ring 48 will be shifted downwardly relative to the collet mounting sleeve 45 to permit the collet arms 50*b* to be cammed outwardly into the longitudinally extending windows 45*d* provided in the body of the collet mounting sleeve 45, thus releasing upper housing 20 from lower housing 10, as illustrated in FIG. 2B.

The operation of the apparatus embodying this invention will be readily apparent to those skilled in the art. As previously mentioned, the lower housing 10, with its contents, are run into the well with the perforating gun. The upper housing 20 may be latched to the lower housing 10 by the latching collet 50 and concurrently run into the well. Alternatively, the upper housing 20, together with the latching collet 50, outer sleeve 40 and wireline engagable member 35 may be subsequently lowered by wireline into the well and latchingly engaged in the position illustrated in FIGS. 1A, 1B and 1C to the lower housing 10 by the latching collet 50.

The firing mechanism is actuated either by dropping a detonating bar 18 into impact engagement with the upper end of the wireline engagable element 35 or by imparting a similar downward impact force to such member by jars incorporated in a wireline connected to member 35. In either event, such downward impact force will effect the shearing of shear element 41 and will thus release the wireline engagable member 35 from the upper housing 20 and permit such member, together with the hammer 30, to move downwardly into impact engagement with the primer 28. The detonation of the primer 28 will effect the firing of the downwardly directed shaped charge 25. This explosive charge will fragmentize the solid end wall 20*a* of the upper housing 20 and the solid end wall 10*e* of the lower housing 10, thus resulting in the detonation of the booster charge 6. The detonation of the booster charge 6 will effect the detonation of the primer cord PC which, in turn, will effect the discharge of all the shaped charges contained in the perforating gun. In some cases, the booster charge 6 may be eliminated and the primer cord PC can be directly detonated by the shaped charge 25. Thus said primer cord, with or without the booster charge 6 constitutes a detonatable firing element for the perforating gun.

If for any reason the primer 28 does not detonate, or the downwardly directed explosive charge 25 is not discharged, the entire upper housing 20 containing these defective elements may be removed from the well by engaging the fishing neck 35*a* of the member 35 with a wireline operated fishing head. Upward force applied to the member 35 will effect the shearing of shear screws 49 and the release of the latching collet 50 from latching engagement with the lower housing 10, permitting all of the upper housing 20, the outer sleeve 40, the collet mounting sleeve 45 and the latching collet 50 to be removed from the well, as shown in FIGS. 2A and 2B. Upon replacement or repair of the defective firing elements of this assemblage, the entire upper housing assemblage can then again be reinserted in the well by wireline and secured in the position illustrated in FIGS. 1A, 1B, and 1C through the engagement of the latching collet 50 with the lower housing 10. During the downward passage of the upper housing assemblage into the well, it should be noted that any obstructions encountered by the depending collet mounting sleeve 45 will not result in the production of any force tending to move the hammer 30 toward engagement with the primer 28.

It is therefore apparent that the aforedescribed invention provides the well operator with an unusual degree of flexibility in that he can select the time for arming the downhole portion of the firing mechanism by wireline, and in the event of a failure of the firing mechanism to function, he may conveniently remove the defective portion of the firing mechanism for repair and replacement without necessitating the pulling of the entire tubing string upon which the perforating gun is suspended.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A replaceable firing mechanism for a subterranean well perforating gun, comprising: a first hollow housing attachable to the top end of a perforating gun and having a thin walled top end surface closing the bore of the hollow housing; a detonatable firing element positioned within said first hollow housing and operatively connected to said perforating gun; a wireline carried firing assembly including a second housing having a thin walled bottom end surface; an impact detonatable primer fixedly mounted in said housing; a hammer axially slidable in said second housing between a remote and contiguous position relative to said primer; a wireline attached member fixedly secured to said hammer; means secured to said wireline attachable member for detachably engaging said first and second hollow housings, whereby said solid end of said second housing may be positioned in vertical abutment to said top end surface of said first housing; and means for transferring the detonating energy of said primer to said detonatable firing element, whereby a downward impact force on said wireline attachable member will sequentially detonate said primer, said detonatable firing element and said perforating gun.

2. The apparatus defined in claim 1 wherein said means for transferring the detonating energy of said primer to said detonatable firing element comprises a downwardly directed shaped charge in said second housing having sufficient detonating energy to blow through said bottom end surface of said second housing and said top end wall of said first hollow housing to detonate said detonatable firing element.

3. The apparatus defined in claim 1 wherein said means secured to said wireline attachable member comprises an outer sleeve assembly dependingly attached to said wireline engagable member and surrounding said second housing, said outer sleeve assembly having an upwardly facing internal shoulder supporting said second housing; and means for releasable securing said outer sleeve assembly to said first housing to secure said lower closed end and said upper closed end of said housings in abutting relation, whereby downward movement of said wireline engagable member actuates said firing mechanism.

4. The apparatus of claim 3 wherein said outer sleeve assembly extends downwardly in surrounding relation to the top portions of said first housing; a collet mounted between said outer sleeve assembly and said first housing; said collet having latching arms surrounding said first housing and defining upwardly facing latching surfaces; and a downwardly facing external shoulder formed on said first housing engagable by said upwardly facing latching surfaces on said collet arms.

5. A replaceable firing mechanism for a subterranean well perforating gun, comprising: a first hollow housing having a thin walled closed top end, a booster charge positioned within said first hollow housing adjacent said closed top end; primer cord means for transmitting detonating energy from said booster charge to said perforating gun; a second hollow housing having a thin walled closed bottom end; an impact detonatable primer fixedly mounted in said housing; a hammer axially slidable in said housing between a remote and a contiguous position relative to said primer; a wireline attachable member secured to the top of said hammer; an outer sleeve assembly secured to said wireline attachable member surrounding and vertically supporting said second housing to position said hammer in said remote position; means for releasably securing said outer sleeve assembly to both of said housings, whereby the bottom end of said second hollow housing may be positioned in vertical abutment with said top end surface of said first hollow housing to permit said hammer to move toward said contiguous position; a downwardly directed shaped charge positioned between said primer and said closed bottom end of said second housing; and means for releasbly latching said first and second hollow housings in said vertically abutting positions, whereby a downward impact force on said wireline attachable member successively detonates said primer, said shaped charge, said booster charge, said primer cord means and the perforating gun, and, in the event said primer or said shaped charge does not detonate, said second hollow housing may be unlatched from said first hollow housing by wireline, removed from the well and replaced by another identical second housing.

6. The apparatus of claim 5 wherein said means for releasably securing said first and second housing in axially abutting relation comprises a collet mounted between said outer sleeve assembly and said first hollow housing, said collet having latching arms surrounding said first housing and defining upwardly facing latching surfaces; and a downwardly facing external surface formed on said first hollow housing engagable by said upwardly facing latching surfaces on said collet arms.

7. The apparatus defined in claim 6 further comprising shearable means for securing said collet arms in engagement with said downwardly facing external surface.

8. The apparatus of claim 7 further comprising means for releasably said shearable means from said collet arms by an upward force applied to said wireline attachable member.

9. A replaceable firing mechanism for a subterranean well perforating gun, comprising: a sleeve assembly attachable to the top end of a perforating gun and having a thin top end wall closing the sleeve assembly bore, the length of said assembly being selected to position said top end surface above any anticipated collection of debris accumulating around said sleeve assembly; a booster charge positioned within said sleeve assembly adjacent said end wall; primer cord means for transmitting detonating energy from said booster charge to said perforating gun; a downwardly facing shoulder on the exterior of said sleeve assembly; a wireline carried firing assembly including a hollow housing having a thin walled bottom end; an impact detonatable primer fixedly mounted in said housing; a hammer axially slidable in said housing between a remote and a contiguous position relative to said primer; a wireline attachable member fixedly secured to the top of said hammer; a latching sleeve assembly surrounding and vertically supporting said housing and secured to said wireline attachable member, whereby the bottom end wall of said housing may be positioned in vertical abutment to said top end wall of said latching sleeve; means for transferring the detonating energy of said primer to said booster charge; and means in the bottom portion of said latching sleeve assembly for latchably engaging said downwardly facing surface on said sleeve assembly, whereby a downward impact force on said wireline attachable member will sequentially detonate said primer, said booster charge, said primer cord means and said perforating gun.

10. The apparatus defined in claim 9 wherein said means for transferring the detonating energy of said primer to said booster charge comprises a downwardly directed shaped charge having sufficient detonating energy to blow through said bottom end wall of said hollow housing and said top end wall of said sleeve to detonate said booster charge.

11. The method of firing a downhole perforating gun in a subterranean wall, said gun having a plurality of vertically spaced, shaped charges, comprising the steps of:

(1) mounting a detonatable firing element in a first housing secured to the upper portion of the gun and having a closed upper end and connecting the detonatable firing element to the shaped charges;

(2) mounting a firing mechanism in a second housing having a closed bottom end and a downwardly directed explosive charge positioned above the closed bottom end of the second housing, said firing mechanism being detonatable by a downwardly directed impact force to discharge said explosive charge;

(3) releasably securing said second housing to said closed end housing with said closed bottom end of said second housing disposed in axial juxtaposition to the closed upper end of said first housing; and (4) applying a downwardly directed impact force to said firing mechanism to discharge said downwardly directed explosive charge, fragmentize said juxtaposed closed bottom end and closed top end of said housings and detonate said firing element to fire the perforating gun.

12. The method of claim 11 further comprising, in the event said downwardly directed explosive charge is not discharged, the steps of releasing said second housing from said first housing by wireline, removing said second housing from the well, replacing said second housing with a new unit, and repeating steps (3) and (4) to again attempt to fire said perforating gun.

13. The method of claim 11 wherein said first housing is run into the well with the perforating gun, and said second housing is subsequently run into the well for releasable securement to said first housing.

14. The method of claim 11 wherein said first and second housings are detachably secured together and run into the well with the perforating gun.

* * * * *